US006485124B1

(12) United States Patent
King et al.

(10) Patent No.: US 6,485,124 B1
(45) Date of Patent: Nov. 26, 2002

(54) OPTICAL ALIGNMENT METHOD AND DETECTOR

(75) Inventors: Dave Golman King, Shelbyville, KY (US); Patrick Laurence Kroger, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/897,496

(22) Filed: Jul. 2, 2001

(51) Int. Cl.[7] ..... B41J 29/393; B41J 29/38
(52) U.S. Cl. ..... 347/19; 347/14
(58) Field of Search ..... 347/19, 14, 23, 347/12, 9, 37, 43; 250/559.29

(56) References Cited

U.S. PATENT DOCUMENTS

| | | | | |
|---|---|---|---|---|
| 4,907,013 | A | | 3/1990 | Hubbard et al. |
| 5,250,956 | A | | 10/1993 | Haselby et al. |
| 5,255,009 | A | | 10/1993 | Bauer et al. |
| 5,262,797 | A | | 11/1993 | Boeller et al. |
| 5,289,208 | A | | 2/1994 | Haselby |
| 5,297,017 | A | | 3/1994 | Haselby et al. |
| 5,426,457 | A | | 6/1995 | Raskin |
| 5,430,306 | A | | 7/1995 | Ix |
| 5,448,269 | A | | 9/1995 | Beauchamp et al. |
| 5,534,895 | A | | 7/1996 | Lindenfelser et al. |
| 5,600,350 | A | * | 2/1997 | Cobbs et al. ..... 347/19 |
| 5,644,344 | A | | 7/1997 | Haselby |
| 5,835,108 | A | | 11/1998 | Beauchamp et al. |
| 5,856,833 | A | | 1/1999 | Elgee et al. |
| 5,905,512 | A | | 5/1999 | Beauchamp |
| 5,975,674 | A | | 11/1999 | Beauchamp et al. |
| 6,076,913 | A | | 6/2000 | Garcia et al. |
| 6,084,607 | A | | 7/2000 | Matsuda |
| 6,137,503 | A | | 10/2000 | Hashimoto et al. |
| 6,158,344 | A | | 12/2000 | Walker et al. |
| 6,161,914 | A | | 12/2000 | Haselby |
| 6,164,753 | A | | 12/2000 | Maza et al. |
| 6,172,690 | B1 | | 1/2001 | Angulo et al. |

* cited by examiner

*Primary Examiner*—Raquel Yvette Gordon
*Assistant Examiner*—Charles N. Stewart, Jr.
(74) *Attorney, Agent, or Firm*—Staas & Halsey, LLP

(57) ABSTRACT

An alignment detector that detects an alignment of a printhead of a printer, with the alignment detector including a photodetector and a single focusing element focusing a point on a media to a point on the photodetector. The alignment detector can be used to detect the alignment of the printer by scanning the alignment detector across the media and detecting predetermined marks previously printed on the media by imaging the predetermined marks using the alignment detector. The area between the single focusing element and the photodetector may be filled by a translucent material, such that there is no air gap between the two.

16 Claims, 2 Drawing Sheets

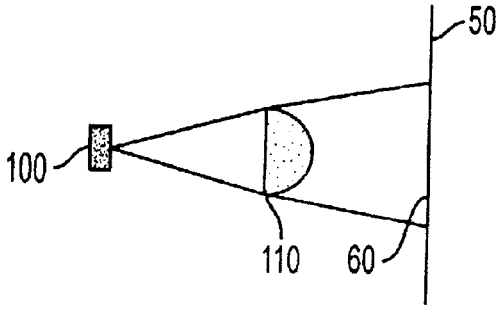
FIG. 1A
(PRIOR ART)
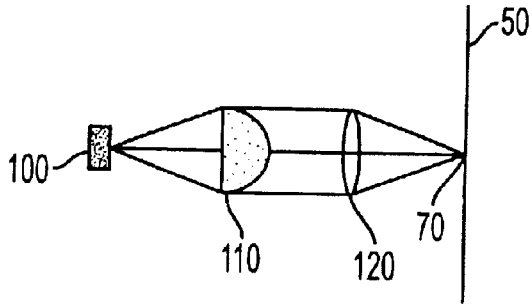
FIG. 1B
(PRIOR ART)
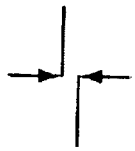
FIG. 2A
FIG. 2B
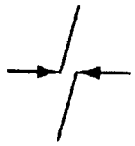
FIG. 2C

OPTICAL ALIGNMENT METHOD AND DETECTOR

BACKGROUND OF THE INVENTION

1. Field of the Invention

The present invention relates to an apparatus and method for detecting a printhead alignment of a printer. More particularly, the present invention relates to an apparatus and method for detecting a printhead alignment of a printer using an optical sensor having a single point focusing element.

2. Description of the Related Art

In the media printing environment it is important to assure that a printing onto a media is performed accurately. For example, in an inkjet printer environment, if the inkjet printhead is out of alignment, the ink will not print on a media in the proper position. To verify the alignment of a printing apparatus, typically an alignment detector is utilized to review predetermined marks made on a media to determine whether the printing apparatus that printed such marks is in alignment.

The alignment detector typically includes at least three components, a light source, an alignment sensor, and a housing to hold both the light source and the sensor, though the housing is not necessary.

FIGS. 1*a* and 1*b* illustrate examples of alignment sensors. FIG. 1*a* illustrates an alignment sensor that focuses light radiating off of surface/media 50 from area 60, using lens 110, onto a point position on phototransistor 100. When detecting a predetermined mark on a printed media the media is usually transported past the alignment detector, and a deviation in a detected signal is used as the indication of a predetermined mark. However, in the arrangement of FIG. 1*a,* because area 60 is quite large, the detection of the predetermined mark becomes difficult, as typically the predetermined mark is much smaller than such an area 60. In addition, the alignment sensor of FIG. 1*a* usually can only detect a relative intensity of a source reflected off surface/media 50. Such that when alignments patterns are printed in many blocks of parallel lines for each different alignment pattern of the printer, the alignment sensor can only measure the relative light intensity reflected off surface/media 50, and uses the pattern that appears darkest to align the printer. The darkest pattern represents the alignment that is one "alignment" factor form the best aligned pattern. Thus, this alignment sensor does not take into account the variations in the media and can be less accurate than point detection, as illustrated in FIG. 1*b*. FIG. 1*b* illustrates a different alignment sensor that focuses light radiating off surface/media 50, a point 70, using lenses 120 and 110, onto a point position of phototransister 100. In this configuration, the detection of the predetermined mark is more accurate, as point 70 is usually quite small. However, such an arrangement also has it's drawbacks. To perform the point detection at point 70, the alignment sensor of FIG. 1*b* requires an additional lens 120. The alignment sensor of FIG. 1*b* may also include a filter to block out interfering light sources. Alternate alignment sensor systems may perform such point detection using even more additional lenses, rather than just lenses 110 and 120. When manufacturing multiple printing apparatuses, or any apparatus which have need of such an alignment sensor, the extra focusing elements excessively drive up costs of the alignment detector.

In an alignment detector configuration, the source may be a 640 nm red Light Emitting Diode (LED). Black and cyan inks absorb light at this wavelength and therefore may be detected when compared to the media background. The source LED wavelength can be changed if other ink colors require detection. For example, magenta ink will absorb light from 520–545 nm. A blue LED or white light source will allow all the ink colors to be detected. Typically, the color to mono inkjet cartridges require alignment as well as bidirectional printing from each printhead. Such alignments include mono bidirectional print for normal and draft modes, color bidirectional print for normal and draft modes, and mono to color horizontal and vertical alignment as well as skew alignment for mono printheads. FIGS. 2A and 2B illustrate examples of horizontal alignment. FIG. 2A illustrates the situation where a predetermined mark is out of alignment, while the predetermined mark is in alignment in FIG. 2B. The miss-alignment shown in FIG. 2A is evidence of the nozzles in a printhead being miss-aligned. As inkjet nozzle heights continue to increase, skew becomes an important measurement. Skew is the measure of how well the printhead is aligned vertically with the media. For example, a vertical line is printed in a full head height of the printhead and a second vertical line is printed in the same horizontal location but below the first line, as illustrated in FIG. 2C. The measure of skew is how well the top of the second line aligns with the bottom of the first line.

Previous implementations of printer alignment have been illustrated in Hubbard et al., U.S. Pat. No. 4,907,013, which illustrates a circuitry design for detecting a malfunction of an inkjet printhead, Lindenfelser et al., U.S. Pat. No. 5,534,895, which illustrates a method and apparatus for adjusting the quality of a printing, Matsuda, U.S. Pat. No. 6,084,607, which illustrates an inkjet printer detecting test patterns and detecting a deviation in the relative positioning of printheads, and in Beauchamp et al., U.S. Pat. No. 5,448,269, and Beauchamp et al., U.S. Pat. No. 5,975,674, both setting forth inkjet printhead alignment. However, none of these references sufficiently solve the aforementioned problems.

Thus, the present invention overcomes the problems associated with previous alignment detectors, including the inability of accurately detect predetermined printed marks on a media and performing such detection with a minimum number of elements.

SUMMARY OF THE INVENTION

An object of the present invention is to detect an alignment of a printer using an optical sensor having a single point focusing element Another object of the present invention is to provide a printing apparatus, including a light source and an alignment sensor, wherein the alignment sensor includes a single focusing element to image a point on a media to a point on a detector. The printing apparatus also includes a control unit to determine whether the printing apparatus is aligned, based on a detection by the alignment sensor of a predetermined mark on the media.

Another object of the present invention is to provide a method of detecting a missalignment of an apparatus, including scanning a media for a predetermined mark, detecting the predetermined mark based upon an imaging of a point on the media, onto a point on a detector, by a single focusing element, and determining whether the apparatus is miss-aligned based on whether the detected predetermined mark is in predetermined position on the media.

A further object of the present invention is to provide an alignment detector, including a single focusing element, made of a translucent material, to focus an image of a point on a media to a point on a detector, wherein the area between the detector and single focusing element is filled with the translucent material.

BRIEF DESCRIPTION OF THE DRAWINGS

Advantages of the invention will become apparent and more readily appreciated from the following description of the preferred embodiments, taken in conjunction with the accompanying drawings of which:

FIGS. 1A and 1B illustrate examples of alignment sensors in an alignment detector;

FIGS. 2A–2C illustrate predetermined marks utilized in performing alignment, with FIGS. 2A and 2C illustrating miss-alignment, and FIG. 2B illustrating proper alignment;

DETAILED DESCRIPTION OF THE PREFERRED EMBODIMENTS

Figure 3:
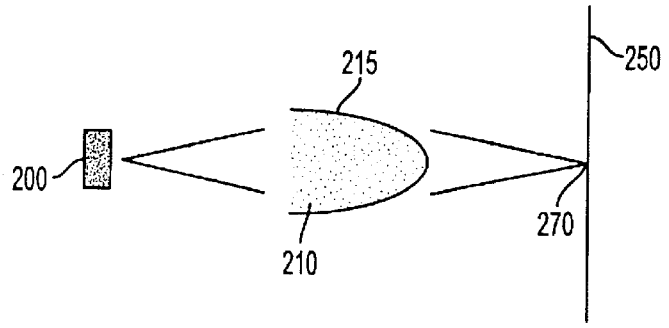
FIG. 3 illustrates an embodiment of the present invention including an alignment sensor having a photodetector and a single focusing element.

Reference will now be made in detail to the preferred embodiments, examples of which are illustrated in the accompanying drawings, wherein like reference numerals refer to like elements throughout. In accordance with the preferred embodiments, there is provided a method and apparatus for optical alignment point detecting a predetermined mark on a media using a single focusing element and an improved photodetector.

FIG. 3 illustrates an embodiment of the present invention including an alignment sensor having a photodetector 200 and a single focusing element 210. As illustrated in FIGS. 1A and 1B. previous alignment sensors included at least one convex lens 110 for focusing light radiating off of surface/media 50. However, to perform point detection an additional lens 120 was needed, as illustrated in FIG. 1B. FIG. 3 illustrates a point detection enabled alignment sensor where focusing element 210 is also a convex lens, but has been modified to both focus light from a point 270 on media 250 and focus that light to a point on photodetector 200. Focusing element 210 is a single focusing element because there is only one focusing operation being performed, i.e., by surface 215 of focusing element 210. Additional lenses are not necessary, as all that is required is that point focusing be performed by focusing element 210. In an embodiment of the present invention, focusing element 210 images an object 3 mm in front of it onto photodetector 200, which is placed 3 mm behind focusing element 210, though the focal length of focusing element 210 can be adjusted in alternative embodiments. Focusing element 210 is a single focusing element because there is only one focusing operation being performed, i.e., by surface 215 of focusing element 210. Additional lenses are not necessary, as all that is required is that point focusing be performed by focusing element 210. In an embodiment of the present invention, focusing element 210 images an object 3 mm in front of it onto photodetector 200, which is placed 3 mm behind focusing element 210, though the focal length of focusing element 210 can be adjusted in alternative embodiments.

In an embodiment of the present invention, both photodetector 200 and focusing element 210 may be encapsulated in a material, such as a translucent polymer, though not limited thereto. Alternatively, the area between focusing element 210 and photodetector 200 could be filled with the same material without fully encapsulating both elements. In addition, when photodetector 200 and focusing element 210 are encapsulated in the material, or include the material in the area separating the two, with focusing element 210 being made of the same material, there would not be any refraction effects from light exiting focusing element 210 and radiating onto photodetector 200. Alternatively, when photodetector 200 and focusing element 210 are separated, by air for example when the area between focusing element 210 and photodetector 200 is not completely filled with the aforementioned material, the design of focusing element 210 has to be modified to compensate for these refracting effects, as well as the refracting effect of any air between photodetector 200 and focusing element 210.

Thus, embodiments of the present invention include an alignment sensor that has a minimum number of focusing elements, while still producing a point detection. Further, as an embodiment includes focusing element 210 and photodetector 200 being encapsulated in a material, with focusing element 210 being made of the same material, focusing element 210 does not have to compensate for refraction of light, and the alignment sensor can be made into a single unit easily mass produced at a low cost.

Figure 4A:
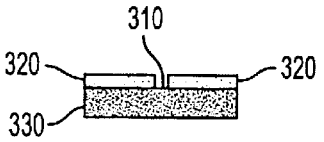
FIGS. 4A and 4B illustrate embodiments of the photodetector of the present invention, with FIG. 4A showing a side view of the photodetector, and FIG. 4B showing a top view of the photodetector.
Figure 4B:
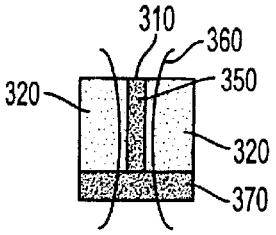

In addition to focusing element 210 being a single focusing element, alignment sensor resolution may be further enhanced by placing an aperture on photodetector 200. In an embodiment of the present invention, the aperture shape is a 5 mil slit along the entire die length of photodetector 200 and may be arranged to be parallel to the predetermined marks on the media that are in a vertical orientation, for example. The point focusing being performed by focusing element 210 would include point focusing onto an area including the aperture shape formed on photodetector 200. FIGS. 4A and 4B illustrate a die 330 of photodetector 200, with FIG. 4A showing a side view and FIG. 4B showing a top view. As shown in FIG. 4A, die 330 is coated with a mask layer 320, which may be made of a metal for example, with a groove being formed in mask layer 320 to generate aperture 310. In an alternative embodiment, aperture 310 may include a crossing groove, slanted grooves, a circular shaped cavity, or any other form that may correspond to the type of predetermined mark printed on the media, photodetector 200 is designed to detect. For example, if the predetermined mark has been printed by a vertical row of inkjet nozzles, then the vertical groove formed by mask layer 320 would allow for a detection of any miss-alignment in those vertical nozzles. FIG. 4B shows a top view of photodetector 200, with an object image 360 being imaged onto aperture 310, as well as being blocked by mask layer 320, and detected by photodetector 350 connected to transistor 370 and placed atop die 330.

Figure 5:
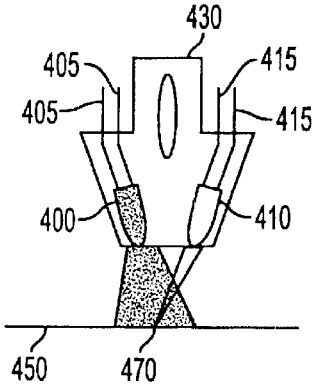
FIG. 5 illustrates an alignment detector embodiment of the present invention where a light source and alignment sensor are supported by a housing.

FIG. 5 illustrates an embodiment of the present alignment detector, including light source 400 and alignment sensor 410 in a housing 430. As illustrated in FIG. 5, when light source 400 irradiates media 450, alignment sensor 410 detects a predetermined mark at point 470. Although FIG. 5 illustrates alignment sensor 410 partially protruding from housing 430, this is not necessary, as alignment sensor 410 could be further embedded into housing 430, whereby housing 430 would become a type of aperture blocking some light from entering alignment sensor. In the embodiment illustrated in FIG. 5, alignment sensor 410 does not include an external aperture blocking incoming light, as it focuses all light radiating to a focusing element of alignment sensor 410 to a photodetector therein. In addition, traditionally in light detectors the light sensors may be embedded into a housing or placed at the end of light tubes or cavities within the housing, forming an aperture. This typical arrangement provides for a mechanism to absorb unwanted light, by the sides of the housing or light tube, and guide the remaining light to the light sensor. However, in alignment sensor 410 of the present embodiment of the invention, all light radiating to the focusing element is point focused to a photodetector, i.e., converging the incoming light to a point on the photodetector and thereby preventing a majority of the light from escaping from the focusing operation and improperly influencing an alignment detection. Thus, as there is no need of having an absorbing material, such as the sides of a housing or light tube, alignment sensor 410 would not need such light tubes or cavities in the housing.

Further, FIG. 5 also shows that light source 400 and alignment sensor 410 may be easily connected to a controller of a printing apparatus, for example, by lead contacts 405, for light source 400, and lead contacts 415, for alignment sensor 410. The controller may control the movement of the alignment detector, or the movement of the media in relation thereto. The controller may also determine from the detection of the predetermined mark, or from a plurality of marks, whether the printing apparatus is in alignment, e.g., if the printheads of a printing apparatus are in alignment. Though, the detection of the predetermined marks may also be used by the controller to also determine whether other parts of the printing apparatus are out of alignment.

As illustrated in FIG. 5, a large area of media 450 is illuminated with light source 400, which may be any light source enabling detection of ink printed on media 450. The large area illumination, in this embodiment, insures that any misalignments of alignment sensor, in housing 430, or made during manufacturing thereof, will be compensated for. Preferably, the distance between the focusing element of alignment sensor 410 and point 470 on media 450 should be the same distance as the focal distance between the focusing element and photodetector within alignment sensor 410, though the focusing element may be modified to account for any deviances from such an arrangement by altering the shape of the focusing element. In addition, an aperture and the focal length of alignment sensor 410 may be modified to allow for either larger or smaller object detection.

As noted above, when a media is being transported beneath housing 430, or as housing 430 is being transported across the media, predetermined marks printed on media 450 can be accurately detected by their detected reflections off of media 450.

Alignment sensor 410 may be operated in digital mode by the aforementioned controller, and can be connected electrically to a Schmitt trigger, for example, or the Schmitt trigger may be integrated onto die 330, shown in FIG. 4A. Typically, when the housing is transported across media 450 at a constant velocity, the predetermined marks printed on media 450 will cause a state change on the output of alignment sensor 410. In addition, these changes in output can be analyzed to determine the relative time or distance between the predetermined marks. For example, if housing 430 is being transported at 5 inches/second and the sample frequency of alignment sensor 410 output is 5 khz, then every sample is spaced by 1/1000 of an inch. Alignment sensor 410 may also be operated in analog mode by the aforementioned controller, where the magnitude of the predetermined marks printed on media 450 can be determined based on how much light is returned to alignment sensor 410. This is useful when the predetermined marks are small. Small changes between predetermined marks can be measured using data corresponding to the amplitude and width of detected predetermined marks, which is also useful in determining a relative darkness or lightness of the predetermined marks.

Further, although the alignment detector according to embodiments of the present invention has only been described in a printing environment having a transport unit to move a media and/or move the housing supporting the alignment detector, it would be equally applicable in any environment which would benefit from point detection using a minimal number of sensor elements.

Thus, although a few preferred embodiments of the present invention have been shown and described, it would be appreciated by those skilled in the art that changes may be made in these embodiments without departing from the principles and spirit of the invention, the scope of which is defined in the claims and their embodiments.

What is claimed is:

1. A printing apparatus, comprising:

a light source;

an alignment sensor, wherein said alignment sensor includes a detector and a single focusing element to image a point on a media to a point on the detector; and a control unit to determine whether said printing apparatus is aligned based on a detection by the alignment sensor of a predetermined mark on the media.

2. The printing apparatus of claim 1, wherein a translucent material fills an area between the single focusing element and the detector to prevent an air gap between the single focusing element and the detector.

3. The printing apparatus of claim 2, wherein the translucent material is a clear polymer.

4. The printing apparatus of claim 2, where the single focusing element is constructed of the translucent material.

5. The printing apparatus of claim 1, wherein the light source and alignment sensor are supported by a housing, wherein the housing is positioned a distance away from the media equal to a focal length of the alignment sensor.

6. The printing apparatus of claim 1, wherein the detector is a photodetector having an aperture.

7. The printing apparatus of claim 6, wherein the aperture is shaped to conform with the shape of the predetermined mark.

8. The printing apparatus of claim 1, further comprising a housing supporting the light source and alignment sensor, such that there is not an aperture blocking light from irradiating to the single focusing element.

9. A method of detecting a mis-alignment of an apparatus, comprising:

scanning a media for a predetermined mark;

detecting the predetermined mark based upon an imaging of a point on the media, onto a point of a detector, by a single focusing element; and determining whether the apparatus is mis-aligned based on whether the detected predetermined mark is in a predetermined position on the media.

10. The method of claim 9, wherein the imaging of the point onto the detector includes radiating the image through a translucent material filling an area between the single focusing element and the detector.

11. The method of claim 9, wherein the detector includes an aperture shaped to conform with the shape of the predetermined mark.

12. The method of claim 9, wherein the detecting of the predetermined mark is performed by detecting light reflecting off of the media, by focusing, using the single focusing element, an image of the predetermined mark on the detector, without first blocking a portion of the reflected light radiating to the single focusing element.

13. An alignment detector, comprising:

a single focusing element, made of a translucent material, to focus an image of a point on a media to a point on a detector, wherein the area between the detector and single focusing element is filled with the translucent material.

14. The alignment detector of claim 13, wherein the detector includes an aperture shaped to conform with the shape of predetermined marks on the media.

15. The alignment detector of claim 13, further comprising a housing supporting a light source and the single focusing element and detector.

16. The alignment detector of claim 15, wherein there is no aperture blocking light from radiating to the single focusing element.

* * * * *